US010465946B2

(12) United States Patent
Sul et al.

(10) Patent No.: US 10,465,946 B2
(45) Date of Patent: Nov. 5, 2019

(54) REFRIGERATOR AND A METHOD CONTROLLING THE SAME

(71) Applicant: LG ELECTRONICS INC., Seoul (KR)

(72) Inventors: Heayoun Sul, Seoul (KR); Dongseok Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 342 days.

(21) Appl. No.: 15/326,051

(22) PCT Filed: Jul. 15, 2015

(86) PCT No.: PCT/KR2015/007346

§ 371 (c)(1),
(2) Date: Jan. 13, 2017

(87) PCT Pub. No.: WO2016/013800

PCT Pub. Date: Jan. 28, 2016

(65) Prior Publication Data

US 2017/0219254 A1 Aug. 3, 2017

(30) Foreign Application Priority Data

Jul. 21, 2014 (KR) ..... 10-2014-0091862

(51) Int. Cl.
*F25B 5/02* (2006.01)
*F25B 1/10* (2006.01)
(Continued)

(52) U.S. Cl.
CPC ..... *F25B 5/02* (2013.01); *F25B 1/10* (2013.01); *F25B 47/02* (2013.01); *F25D 11/022* (2013.01);
(Continued)

(58) Field of Classification Search
CPC .... F25B 5/02; F25B 47/02; F25B 5/04; F25B 1/10; F25B 41/00; F25B 123/00;
(Continued)

(56) References Cited

U.S. PATENT DOCUMENTS

2008/0178621 A1* 7/2008 Kang ..... F25B 5/04 62/179
2010/0287961 A1* 11/2010 Song ..... F25B 5/04 62/81
(Continued)

FOREIGN PATENT DOCUMENTS

CN 1324277 7/2007
CN 104344587 2/2015
(Continued)

OTHER PUBLICATIONS

CN Office Action in Chinese Patent Application No. 201580033939.0, dated Jul. 25, 2018, pages (with English Translation).
(Continued)

*Primary Examiner* — Emmanuel E Duke
(74) *Attorney, Agent, or Firm* — Fish & Richardson P.C.

(57) ABSTRACT

Provided are a refrigerator and a control method thereof. The refrigerator according to the embodiment includes a compressor configured to compress a refrigerant; a condenser configured to condense the refrigerant compressed by the compressor; a flow control part disposed at an exit side of the condenser to switch a flow direction of the refrigerant condensed by the condenser; a plurality of branch pipes configured to extend from the flow control part; an expander installed at the plurality of the branch pipes to depressurize the refrigerant; a plurality of evaporators connected to the plurality of branch pipes; and a bypass pipe configured to extend from an exit side of one of the plurality of evaporators to an entrance side of the other evaporator and having
(Continued)

a bypass expander installed thereat to depressurize the refrigerant.

6 Claims, 7 Drawing Sheets

(51) Int. Cl.
*F25B 47/02* (2006.01)
*F25D 11/02* (2006.01)
*F25D 21/12* (2006.01)
*F25D 17/06* (2006.01)

(52) U.S. Cl.
CPC ..... *F25D 17/067* (2013.01); *F25D 21/12* (2013.01); *F25B 2341/066* (2013.01); *F25B 2400/0401* (2013.01); *F25B 2400/0409* (2013.01); *F25B 2400/0411* (2013.01)

(58) Field of Classification Search
CPC ..... F25B 2400/075; F25B 2400/0411; F25B 2400/0409; F25B 2400/0401; F25B 2341/066; F25D 17/067; F25D 21/12; F25D 11/022; B60H 1/00885
See application file for complete search history.

(56) References Cited

U.S. PATENT DOCUMENTS

2012/0023978 A1* 2/2012 Chae ..... F25B 1/10 62/115
2012/0023981 A1* 2/2012 Chae ..... F25B 5/02 62/115
2012/0312034 A1* 12/2012 Oh ..... F25B 1/10 62/84
2013/0186129 A1 7/2013 Bae
2013/0340454 A1* 12/2013 Kim ..... F25B 1/10 62/126
2015/0040591 A1* 2/2015 Lim ..... F25B 5/02 62/118

FOREIGN PATENT DOCUMENTS

EP 2677252 A1 12/2013
JP H04-356677 12/1992
JP 2002-062026 2/2002
JP 2014-119122 6/2014
KR 10-0182726 12/1998
KR 785118 A1 12/2007
KR 10-2009-0046291 5/2009

OTHER PUBLICATIONS

Extended European Search Report in European Application No. 15825222.1, dated Feb. 12, 2018, 7 pages.

* cited by examiner

【Figure 1】
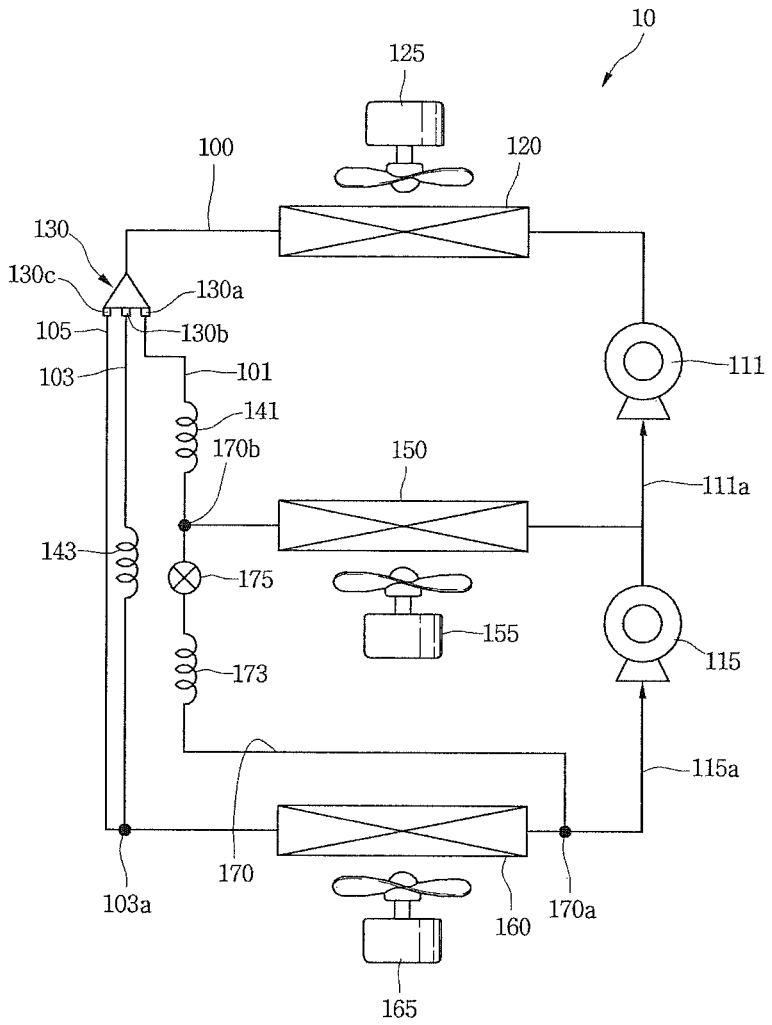

【Figure 2】
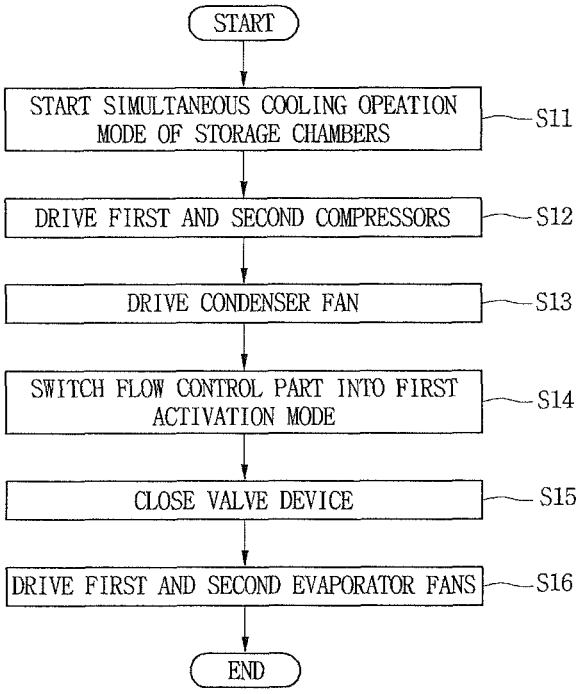

【Figure 3】
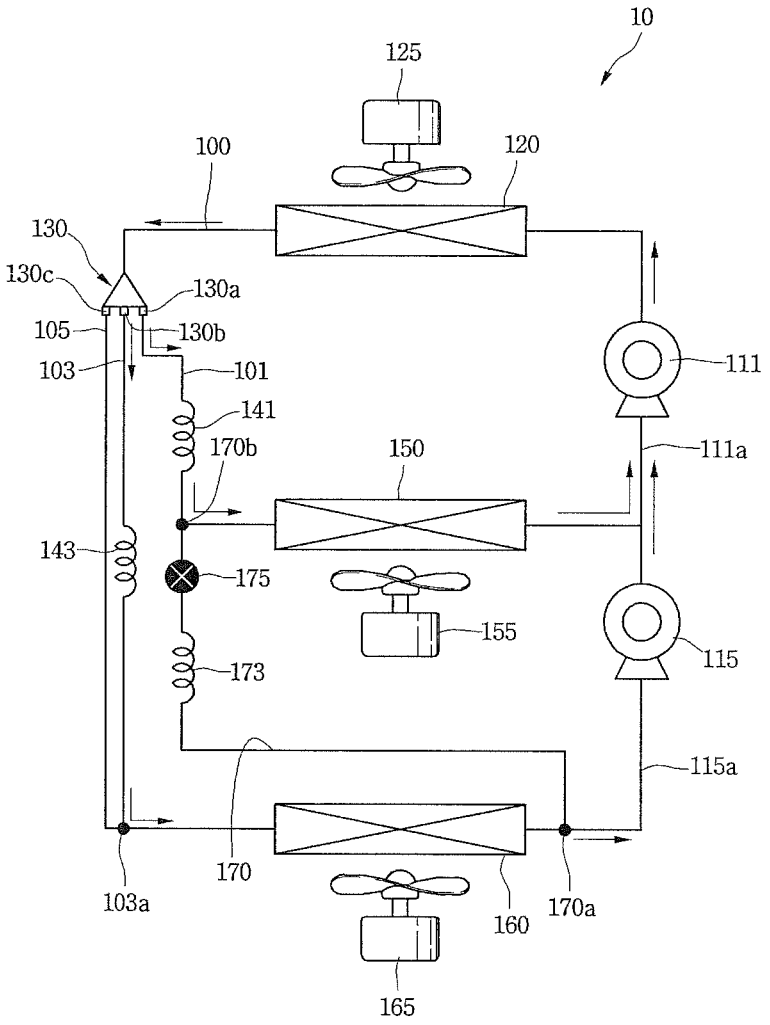

【Figure 4】
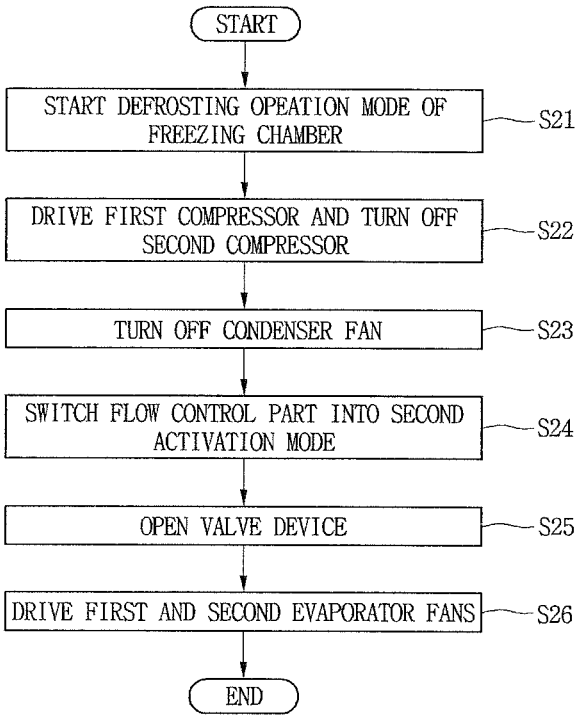

【Figure 5】
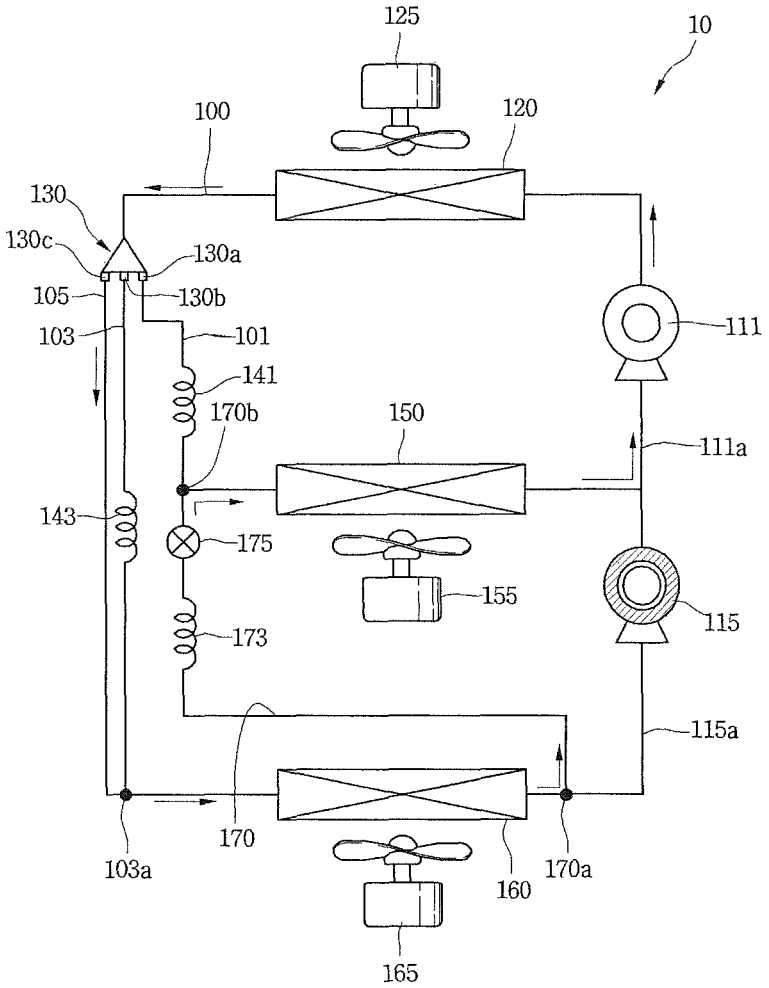

【Figure 6】
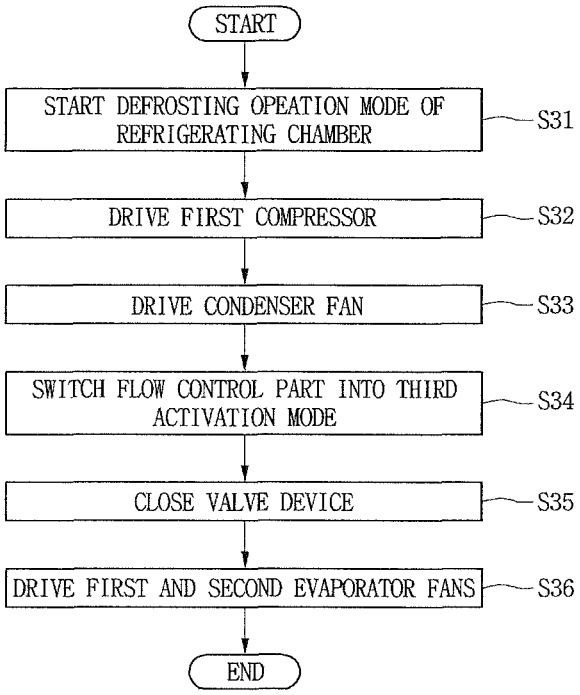

【Figure 7】
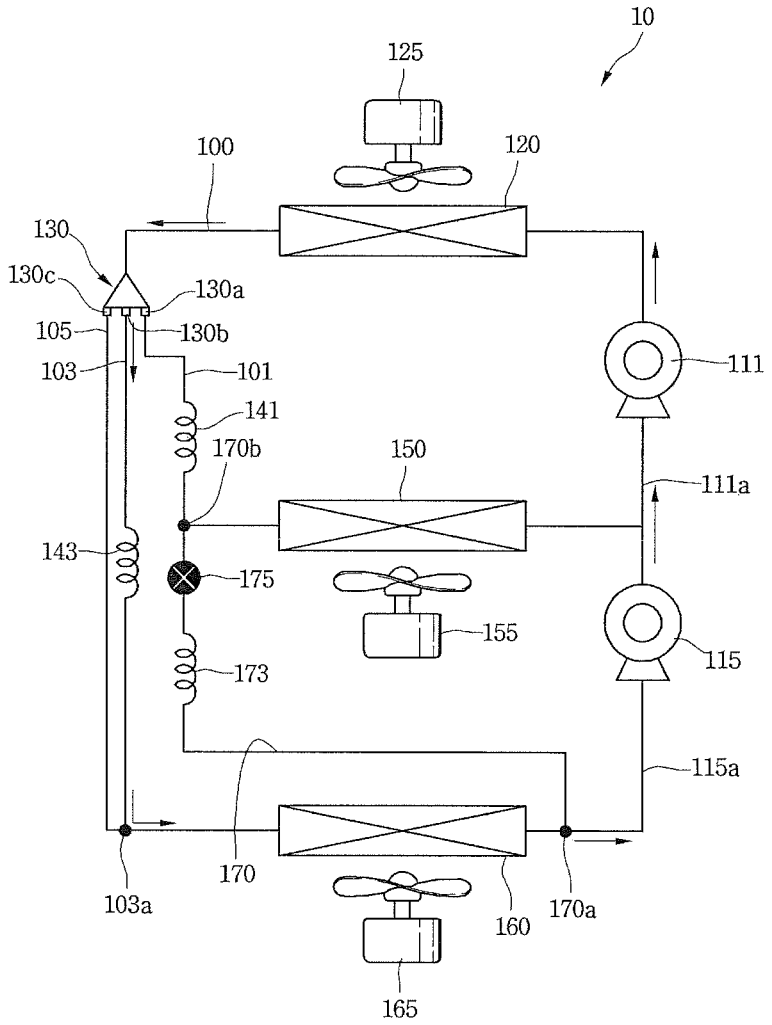

REFRIGERATOR AND A METHOD CONTROLLING THE SAME

CROSS REFERENCE TO RELATED APPLICATIONS

This application is a U.S. National Phase Application under 35 U.S.C. § 371 of International Application PCT/KR2015/007346, filed on Jul. 15, 2015, which claims the benefit of Korean Application No. 10-2014-009186, filed on Jul. 21, 2014, the entire contents of which are hereby incorporated by reference in their entireties.

TECHNICAL FIELD

The present disclosure relates to a refrigerator and a method of controlling the same.

BACKGROUND ART

Generally, a refrigerator has a plurality of storage chambers for accommodating and keeping food frozen or refrigerated, and one surface of each storage chamber is opened to receive or take out the food. The plurality of storage chambers include a freezing chamber for keeping the food frozen and a refrigerating chamber for keeping the food refrigerated.

In the refrigerator, a refrigeration system in which a refrigerant is circulated is driven. The refrigeration system includes a compressor, a condenser, an expander and an evaporator. The evaporator may include a first evaporator which is provided at one side of the refrigerating chamber, and a second evaporator which is provided at one side of the freezing chamber.

Cold air stored in the refrigerating chamber is cooled while passing through the first evaporator, and the cooled air may be supplied to the refrigerating chamber again. Cold air stored in the freezing chamber is cooled while passing through the second evaporator, and the cooled air may be supplied to the freezing chamber again.

As described above, the conventional refrigerator is configured so that the plurality of storage chambers are independently cooled through separate evaporators.

In this connection, the applicant has got a patent on an invention (Korean Patent No. 10-1275184 registered on Jun. 10, 2013)

In a refrigeration system of the above-described patent, there are disclosed a compressor, a condenser, a refrigerant supply unit, an expander, a first evaporator and a second evaporator. It may be understood that the first and second evaporators are heat exchangers which are provided to independently cool separate storage chambers.

The refrigerant supply unit may be configured with a three-way valve, and a refrigerant introduced into the refrigerant supply unit may be guided to the first evaporator or the second evaporator.

That is, the above-described patent is characterized in that the refrigerant is selectively supplied to the first evaporator or the second evaporator, performs a cooling operation in one of the plurality of storage chambers, and stops the cooling operation in other storage chambers.

As described above, in the conventional refrigerator, the plurality storage chambers are not cooled at the same time, but one storage chamber and the other storage chamber are selectively or alternately cooled. In this case, the storage chamber in which the cooling operation is performed may be maintained within an appropriate range of temperature, but a temperature of the storage chamber in which the cooling operation is not performed is increased and is out of a normal range.

When the cooling operation of one storage chamber is required, and it is also detected that the temperature of the other storage chamber is out of the normal range, the cooling operation of the other storage chamber may not be immediately performed. That is, in a structure in which the storage chambers are independently cooled, the cold air may not be supplied to a proper place, and thus operation efficiency of the refrigerator is lowered.

Meanwhile, the conventional refrigerator includes a defrosting heater which is installed at each one side of the first and second evaporators to remove frost generated on the first or second evaporator. When the defrosting heater is driven, excessive power consumption occurs.

DISCLOSURE

Technical Problem

Embodiments provide a refrigerator which is capable of operating a refrigerating chamber and a freezing chamber at the same time and effectively performing a defrosting operation, and a control method thereof.

Technical Solution

In one embodiment, a refrigerator includes a compressor configured to compress a refrigerant, a condenser configured to condense the refrigerant compressed by the compressor, a flow control part disposed at an exit side of the condenser to switch a flow direction of the refrigerant condensed by the condenser, a plurality of branch pipes configured to extend from the flow control part, an expander installed at the plurality of the branch pipes to depressurize the refrigerant, a plurality of evaporators connected to the plurality of branch pipes, and a bypass pipe configured to extend from an exit side of one of the plurality of evaporators to an entrance side of the other evaporator and having a bypass expander installed thereat to depressurize the refrigerant.

The plurality of evaporators may include a refrigerating chamber side evaporator installed at a side of a refrigerating chamber and configured to supply cold air to the refrigerating chamber; and a freezing chamber side evaporator installed at a side of a freezing chamber and configured to supply the cold air to the freezing chamber.

The plurality of branch pipes may include a first branch pipe configured to extend from the flow control part to the refrigerating chamber side evaporator; and second and third branch pipes configured to extend from the flow control part to the freezing chamber side evaporator.

The second branch pipe may include a first connection part to which the third branch pipe is connected.

The expander may include a first expander installed at the first branch pipe to depressurize the refrigerant, and a second expander installed at the second branch pipe to depressurize the refrigerant.

The compressor may include a first compressor installed at an exit side of the refrigerating chamber side evaporator; and a second compressor installed at an exit side of the freezing chamber side evaporator, and the refrigerant compressed by the second compressor may be introduced into the first compressor.

The refrigerator may further include a second inlet pipe configured to extent from the refrigerating chamber side evaporator to the second compressor, a second connection part which is provided at the second inlet pipe and to which one end of the bypass pipe is connected; and a third connection part which is provided at the first branch pipe and to which the other end of the bypass pipe is connected.

A valve device configured to selectively open and close the bypass pipe may be installed at the bypass pipe.

The flow control part may discharge the refrigerant condensed by the condenser to the first and second branch pipes in a simultaneous cooling operation mode of storage chambers, may discharge the refrigerant condensed by the condenser to the third branch pipe in a defrosting operation mode of the freezing chamber, and may discharge the refrigerant condensed by the condenser to the second branch pipe in a defrosting operation mode of the refrigerating chamber.

In another embodiment, a method of controlling a refrigerator which includes a compressor, a condenser, a first evaporator, a second evaporator, and a flow control part installed at entrance sides of the first and second evaporators, includes driving the compressor and operating a refrigeration cycle, controlling an activation mode of the flow control part so that a refrigerant is supplied to at least one of the first and second evaporators; and selectively opening a bypass pipe configured to extend from an exit side of the second evaporator to an entrance side of the first evaporator.

The method may further include a first branch pipe which extends from the flow control part to the first evaporator and at which a first expander is installed, a second branch pipe which extends from the flow control part to the second evaporator and at which a second expander is installed, and a third branch pipe which extends from the flow control part to the second evaporator.

In a first operation mode of the refrigerator, the flow control part may be switched into a first activation mode to supply the refrigerant to the first and second branch pipes, and the first operation mode may be an operation mode in which the refrigerating chamber and the freezing chamber are cooled.

In a second operation mode of the refrigerator, the flow control part may be switched into a second activation mode to supply the refrigerant to the third branch pipe, and may open a valve device installed at the bypass pipe, and the second operation mode may be an operation mode in which the refrigerating chamber is cooled and the freezing chamber is defrosted.

The method may further include a condenser fan installed at one side of the condenser to generate an air flow, and an evaporator fan installed at each one side of the first and second evaporators, and in the second operation mode of the refrigerator, the condenser fan may be turned off, and the evaporator fan may be driven.

In a third operation mode of the refrigerator, the flow control part may be switched into a third activation mode to supply the refrigerant to the second branch pipe, and may close the valve device installed at the bypass pipe to restrict a flow of the refrigerant, and also may drive a first evaporator fan installed at one side of the first evaporator.

In further another embodiment, a refrigerator includes a low pressure side compressor configured to compress a refrigerant, a high pressure side compressor configured to compress the refrigerant compressed by the low pressure side compressor, a condenser disposed at an exit side of the high pressure side compressor to condense the refrigerant; a flow control part disposed at an exit side of the condenser to control a flow direction of the refrigerant condensed by the condenser; first, second and third branch pipes configured to extend from the flow control part; an expander installed at the first and second branch pipes to depressurize the refrigerant; a first evaporator connected to the first branch pipe and configured to supply cold air to a refrigerating chamber; a second evaporator connected to the second branch pipe and configured to supply the cold air to a freezing chamber, a bypass pipe configured to cool the refrigerating chamber and to guide the refrigerant passing through the second evaporator to an inlet side of the first evaporator in an operation mode for defrosting the second evaporator; and a valve device installed at the bypass pipe.

The refrigerator may further include a condenser fan installed at one side of the condenser to generate an air flow, a first evaporator fan installed at one side of the first evaporator, and a second evaporator fan installed at one side of the second evaporator, and in the operation mode for defrosting the second evaporator, the condenser fan may be turned off, and the first and second evaporator fans may be turned on.

In the operation mode, the low pressure side compressor may be turned off, and the high pressure side compressor may be turned on, and the valve device may be opened.

In an operation mode for cooling the freezing chamber and defrosting the first evaporator, the flow control part may be operated to restrict the refrigerant from being supplied to the first evaporator, and also may drive the first evaporator fan to defrost the first evaporator using the cold air of the refrigerating chamber.

The flow control part may include a four-way valve having one introducing part and three discharging parts.

Advantageous Effects

According to the embodiments, since the plurality of evaporators can be operated at the same time, the plurality of storage chambers can be effectively cooled.

Also, since one refrigerant passage extending from the flow control part to the refrigerating chamber side evaporator and two refrigerant passages extending to the freezing chamber side evaporator are installed, and the bypass passage extending to the entrance side of the refrigerating chamber side evaporator is installed at the exit side of the freezing chamber side evaporator, the defrosting operation of the refrigerating chamber or the freezing chamber can be easily performed.

In particular, when the defrosting operation of the freezing chamber is performed, the high temperature refrigerant compressed by the compressor performs the defrosting operation while flowing through the freezing chamber side evaporator, and then is evaporated in the refrigerating chamber side evaporator. Therefore, the cooling operation of the refrigerating chamber can be performed at the same time.

Also, when the defrosting operation of the refrigerating chamber is performed, the defrosting operation of the refrigerating chamber side evaporator can be performed by driving only the fan of the refrigerating chamber, and also the cooling operation of the freezing chamber can be performed at the same time.

DESCRIPTION OF DRAWINGS

FIG. 1 is a system view illustrating a refrigeration cycle of a refrigerator according to an embodiment of the present disclosure.

FIG. 2 is a flowchart illustrating a control method of the refrigerator, when a cooling operation is simultaneously performed at storage chambers according to the embodiment of the present disclosure.

FIG. 3 is a view of the refrigeration cycle illustrating a flow state of a refrigerant, when the cooling operation is simultaneously performed at the storage chambers according to the embodiment of the present disclosure.

FIG. 4 is a flowchart illustrating a control method of the refrigerator, when a defrosting operation is performed at a freezing chamber according to the embodiment of the present disclosure.

FIG. 5 is a view of the refrigeration cycle illustrating a flow state of the refrigerant, when the defrosting operation is performed at the freezing chamber according to the embodiment of the present disclosure.

FIG. 6 is a flowchart illustrating a control method of the refrigerator, when the defrosting operation is performed at a refrigerating chamber according to the embodiment of the present disclosure.

FIG. 7 is a view of the refrigeration cycle illustrating a flow state of the refrigerant, when the defrosting operation is performed at the refrigerating chamber according to the embodiment of the present disclosure.

MODE FOR INVENTION

Hereinafter, exemplary embodiments of the present disclosure will be described in detail with reference to the accompanying drawings. However, the present disclosure is not limited to the exemplary embodiments disclosed below, and those skilled in the art appreciating the ideas of the present disclosure can easily propose other embodiments within the scope of the present disclosure.

FIG. 1 is a system view illustrating a refrigeration cycle of a refrigerator according to an embodiment of the present disclosure.

Referring to FIG. 1, the refrigerator 10 according to the embodiment of the present disclosure includes a plurality of devices which drives the refrigeration cycle.

Specifically, the refrigerator 10 includes a plurality of compressors 111 and 115 which compress a refrigerant, a condenser 120 which condenses the refrigerant compressed by the plurality of compressors 111 and 115, a plurality of expanders 141, 143 and 173 which depressurize the refrigerant condensed by the condenser 120, and a plurality of evaporators 150 and 160 which evaporate the refrigerant depressurized by one of the plurality of expanders 141, 143 and 173.

The refrigerator 10 further includes refrigerant pipes 100 which connect the plurality of compressors 111 and 115, the condenser 120, the expanders 141, 143 and 173 and the evaporators 150 and 160 so as to guide a flow of the refrigerant.

The plurality of compressors 111 and 115 include a second compressor 115 which is disposed at a low pressure side, and a first compressor 111 which further compresses the refrigerant compressed by the second compressor 115. The second compressor 115 may be referred to as a "low pressure side compressor", and the first compressor 111 may be referred to as a "high pressure side compressor".

The first and second compressors 111 and 115 are connected with each other in series. That is, an exit side refrigerant pipe of the second compressor is connected to an entrance side of the first compressor 111.

Specifically, the refrigerant pipe 100 includes a first inlet pipe 111*a* which is provided at the entrance side of the first compressor 111 to guide the refrigerant to the first compressor 111, and a second inlet pipe 115*a* which is provided at an entrance side of the second compressor 115 to guide the refrigerant to the second compressor 115. It is understood that the first inlet pipe 111*a* is the exit side refrigerant pipe of the second compressor 115.

The plurality of evaporators 150 and 160 include a first evaporator 150 which generates cold air to be supplied to one storage chamber of a refrigerating chamber and a freezing chamber, and a second evaporator 160 which generates the cold air to be supplied to the other storage chamber.

For example, the first evaporator 150 may generate the cold air to be supplied to the refrigerating chamber, and may be disposed at one side of the refrigerating chamber. The second evaporator 160 may generate the cold air to be supplied to the freezing chamber, and may be disposed at one side of the freezing chamber. Therefore, the first evaporator 150 may be referred to as a "refrigerating chamber side evaporator", and the second evaporator 160 may be referred to as a "freezing chamber side evaporator".

A temperature of the cold air supplied to the freezing chamber may be lower than that of the cold air supplied to the refrigerating chamber, and thus a refrigerant evaporating pressure of the second evaporator 160 may be lower than that of the first evaporator 150.

An exit side refrigerant pipe 100 of the second evaporator 160 extends to the entrance side of the second compressor 115. Therefore, the refrigerant passing through the second evaporator 160 may be introduced into the second compressor 115.

An exit side refrigerant pipe 100 of the first evaporator 150 is connected to the exit side refrigerant pipe of the second compressor 115, i.e., the first inlet pipe 111*a*. Therefore, the refrigerant passing through the first evaporator 150 may be combined to the refrigerant compressed by the second compressor 115, and then introduced into the first compressor 111.

The plurality of expanders 141, 143 and 173 include a first expander 141 which expands the refrigerant to be introduced into the first evaporator 150, and a second expander 143 which expands the refrigerant to be introduced into the second evaporator 160.

And the plurality of expanders 141, 143 and 173 further includes a third expander 173 which is installed at a bypass pipe 170 extending from an exit side of the second evaporator 160 to an entrance side of the first evaporator 150. The third expander 173 may be referred to as a "bypass expander" distinguished from the first and second expanders 141 and 143.

The first to third expanders 141, 143 and 173 may include capillary tubes.

To allow the refrigerant evaporating pressure of the second evaporator 160 to be lower than that of the first evaporator 150, a diameter of the capillary tube of the second expander 143 may be smaller than that of the capillary tube of the first expander 141.

And it is understood that the third expander 173 is a device which depressurizes the refrigerant when a cooling operation of the refrigerating chamber and a defrosting operation of the freezing chamber are performed. Therefore, the diameter of the capillary tube of the third expander 173 may be larger than that of the capillary tube of the second expander 143.

A first branch pipe 101 which guides an introduction of the refrigerant into the first evaporator 150 is installed at the entrance side of the first evaporator 150. The first expander 141 may be installed at the first branch pipe 101. The first branch pipe 101 serves to guide the introduction of the refrigerant into the first evaporator 150, and thus may be referred to as a "first evaporation passage".

Two branch pipes 103 and 105 which guide the introduction of the refrigerant into the second evaporator 160 is installed at an entrance side of the second evaporator 160. The two branch pipes 103 and 105 include a second branch pipe 103 and a third branch pipe 105. The second expander 143 may be installed at the second branch pipe 103. The second and third branch pipes 103 and 105 serve to guide the introduction of the refrigerant into the second evaporator 160, and thus may be referred to as "second evaporation passages".

The refrigerator 10 further includes a flow control part 130 which introduces the refrigerant into at least one of the first to third branch pipes 101, 103 and 105. The flow control part 130 may control a flow of the refrigerant so that the first and second evaporators 150 and 160 are operated at the same time, i.e., the refrigerant is simultaneously introduced into the first and second evaporators 150 and 160.

The flow control part 130 includes a four-way valve having one introducing part through which the refrigerant is introduced and three discharging parts 130*a*, 130*b* and 130*c* through which the refrigerant is discharged.

The three discharging parts 130*a*, 130*b* and 130*c* of the flow control part 130 are connected to the first to third branch pipes 101, 103 and 105, respectively. Therefore, the refrigerant passing through the flow control part 130 may be discharged to at least one of the first to third branch pipes 101, 103 and 105. The discharging parts connected to the first to third branch pipes 101, 103 and 105 may be referred to as, in turn, a "first discharging part 130*a*", a "second discharging part 130*b*" and a "third discharging part 130*c*".

That is, the first branch pipe 101 extends from the first discharging part 130*a* of the flow control part 130 to the entrance side of the first evaporator 150, and the second branch pipe 103 extends from the second discharging part 130*b* of the flow control part 130 to the entrance side of the second evaporator 160.

The third branch pipe 105 extends from the third discharging part 130*c* of the flow control part 130 to one point 103*a* of the second branch pipe 103. That is, the second branch pipe 103 includes a first connection part 103*a* to which the third branch pipe 105 is connected.

The second inlet pipe 115*a* extending to the second compressor 115 is provided at the exit side of the second evaporator 160. The second inlet pipe 115*a* includes a second connection part 170*a* to which the bypass pipe 170 is connected. That is, one end of the bypass pipe 170 is connected to the second inlet pipe 115*a* through the second connection part 170*a*.

The first branch pipe 101 includes a third connection part 107*b* to which the other end of the bypass pipe 170 is connected. By such a structure, the bypass pipe 170 guides the refrigerant passing through the second evaporator 160 to be introduced into the first evaporator 150.

The third expander 173 and a valve device 175 may be installed at the bypass pipe 170. The third expander 173 may serve to depressurize the refrigerant, and the valve device 175 may selectively open or close the bypass pipe 170. For example, the valve device 175 may include a solenoid valve which allows an on/off control operation.

At least one discharging part of the first to third discharging parts 130*a*, 130*b* and 130*c* may be opened according to an operation mode of the refrigerator.

For example, when a cooling operation is simultaneously performed at both of the refrigerating chamber and the freezing chamber, the first discharging part 130*a* and the second discharging part 130*b* may be opened, and the third discharging part 130*c* may be closed. Such an activation mode of the flow control part 130 is referred to as a "first activation mode".

Meanwhile, when the cooling operation of the refrigerating chamber and a defrosting operation of the freezing chamber are performed, the first discharging part 130*a* and the second discharging part 130*b* may be closed, and the third discharging part 130*c* may be opened. Such an activation mode of the flow control part 130 is referred to as a "second activation mode".

When the cooling operation of the freezing chamber and the defrosting operation of the refrigerating chamber are performed, the first discharging part 130*a* and the third discharging part 130*c* may be closed, and the second discharging part 130*b* may be opened. Such an activation mode of the flow control part 130 is referred to as a "third activation mode".

The operation mode of the flow control part 130 may be determined according to the operation mode of the refrigerator, and a flow route of the refrigerant may be changed according to the activation mode of the flow control part 130.

The refrigerator 10 includes blower fans 125, 155 and 165 which are provided at one sides of the heat exchangers to blow air. The blower fans 125, 155 and 165 include a condenser fan 125 which is provided at one side of the condenser 120, a first evaporator fan 155 which is provided at one side of the first evaporator 150, and a second evaporator fan 165 which is provided at one side of the second evaporator 160.

Heat exchanging performance may be changed according to RPMs of the first and second evaporator fans 155 and 165.

For example, when more cold air is required due to an operation of the first evaporator 150, the RPM of the first evaporator fan 155 may be increased, and when the cold air is sufficient, the RPM of the first evaporator fan 155 may be reduced.

And when more cold air is required due to an operation of the second evaporator 160, the RPM of the second evaporator fan 165 may be increased, and when the cold air is sufficient, the RPM of the second evaporator fan 165 may be reduced.

FIG. 2 is a flowchart illustrating a control method of the refrigerator, when the cooling operation is simultaneously performed at storage chambers according to the embodiment of the present disclosure, and FIG. 3 is a view of the refrigeration cycle illustrating a flow state of a refrigerant, when the cooling operation is simultaneously performed at the storage chambers according to the embodiment of the present disclosure.

Referring to FIGS. 2 and 3, the control method of the refrigerator and the flow of the refrigerant, when the plurality of storage chambers according to the embodiment of the present disclosure, i.e., the refrigerating chamber and the freezing chamber are cooled at the same time, will be described.

In a first operation mode of the refrigerator, i.e., when the storage chambers are cooled at the same time, the first and second compressors 111 and 115 are driven, and thus the refrigerant may be compressed (S11 and S12). The refrigerant compressed by the first and second compressors 111 and 115 is condensed while passing through the condenser 120. At this time, the condenser fan 125 may be driven (S13).

The refrigerant condensed by the condenser 120 may be introduced into the first and second evaporators 150 and 160 through the flow control part 130. At this time, the flow control part 130 may be switched into the first activation mode.

When the flow control part 130 is switched into the first activation mode, the first and second discharging parts 130*a* and 130*b* of the flow control part 130 are opened, and the third discharging part 130*c* is closed. Therefore, the refrigerant may be introduced into the first and second evaporators 150 and 160 through the first and second branch pipes 101 and 103 (S14).

And the valve device 175 is closed, and the flow of the refrigerant through the bypass pipe 170 is restricted. Therefore, the flow of the refrigerant in the first branch pipe 101, which flows from the third connection part 1070*b* to the bypass pipe 170, is restricted, and the flow of the refrigerant passing through the second evaporator 160, which flows from the second connection part 170*a* to the bypass pipe 170, is also restricted (S15).

When the refrigerant passes through the first and second evaporators 150 and 160, the first and second evaporator fans 155 and 165 are driven and serve to assist an evaporation of the refrigerant. The cold air generated from the first evaporator 150 is supplied to the refrigerating chamber to cool the refrigerating chamber, and the cold air generated from the second evaporator 160 is supplied to the freezing chamber to cool the freezing chamber.

The refrigerant passing through the second evaporator 160 flows through the second inlet pipe 115*a*, and is compressed by the second compressor 115, and then discharged into the first inlet pipe 111*a*. The refrigerant passing through the first evaporator 150 may be introduced into the first inlet pipe 111*a*, and may be introduced into the first compressor 111 together with the refrigerant compressed by the second compressor 115. This cycle may be repeated (S16).

FIG. 4 is a flowchart illustrating a control method of the refrigerator, when the defrosting operation is performed at the freezing chamber according to the embodiment of the present disclosure, and FIG. 5 is a view of the refrigeration cycle illustrating a flow state of the refrigerant, when the defrosting operation is performed at the freezing chamber according to the embodiment of the present disclosure.

Referring to FIGS. 4 and 5, the control method of the refrigerator and the flow of the refrigerant, when the cooling operation of the refrigerating chamber and the defrosting operation of the freezing chamber side evaporator are performed according to the embodiment of the present disclosure, will be described.

In a second operation mode of the refrigerator, i.e., when a defrosting operation mode of the freezing chamber is started, the first compressor 111 is driven, and the second compressor 115 is turned off (S21 and S22). The refrigerant compressed by the first compressor 111 passes through the condenser 120. At this time, the condenser fan 125 may be turned off. Therefore, a condensing operation of the refrigerant passing through the condenser 120 may be restricted or reduced (S23).

The refrigerant passing through the condenser 120 may be introduced into the second evaporator 160 through the flow control part 130. At this time, the flow control part 130 may be switched into the second activation mode.

When the flow control part 130 is switched into the second activation mode, the first and second discharging parts 130*a* and 130*b* of the flow control part 130 are closed, and the third discharging part 130*c* is opened. Therefore, the refrigerant flows through the third branch pipe 105, and is introduced from the first connection part 103*a* to the second branch pipe 103, and then flows to the second evaporator 160.

The refrigerant introduced into the second evaporator 160 is in a high temperature and high pressure state compressed by the first compressor 111, and may perform the defrosting operation of the second evaporator 160 while passing through the second evaporator 160. And the second evaporator fan 165 may be driven to condense the refrigerant. That is, the second evaporator 160 may serve as the condenser (S24).

The refrigerant passing through the second evaporator 160 flows from the second connection part 170*a* to the bypass pipe 170. At this time, the valve device 175 is opened to guide the flow of the refrigerant through the bypass pipe 170. And the refrigerant of the bypass pipe 170 may be depressurized while passing through the third expander 173.

The refrigerant flowing through the bypass pipe 170 is introduced from the third connection part 170*b* to the first branch pipe 101, and then flows to the first evaporator 150 (S25).

While the refrigerant passes through the first evaporator 150, the first evaporator fan 155 is driven to assist the evaporation of the refrigerant. The cold air generated by the first evaporator 150 is supplied to the refrigerating chamber so as to cool the refrigerating chamber.

The refrigerant passing through the first evaporator 150 is introduced into the first inlet pipe 111*a*, and then introduced into the first compressor 111. This cycle may be repeated (S26).

FIG. 6 is a flowchart illustrating a control method of the refrigerator, when the defrosting operation is performed at the refrigerating chamber according to the embodiment of the present disclosure, and FIG. 7 is a view of the refrigeration cycle illustrating the flow state of the refrigerant, when the defrosting operation is performed at the refrigerating chamber according to the embodiment of the present disclosure.

Referring to FIGS. 6 and 7, the control method of the refrigerator and the flow of the refrigerant, when the cooling operation of the freezing chamber and the defrosting operation of the refrigerating chamber side evaporator are performed according to the embodiment of the present disclosure, will be described.

In a third operation mode of the refrigerator, i.e., when the defrosting operation mode of the refrigerating chamber is started, the first and second compressors 111 and 115 are driven to compress the refrigerant (S31 and S32). The refrigerant compressed by the first and second compressors 111 and 115 is condensed while passing through the condenser 120. At this time, the condenser fan 125 may be driven (S33).

The refrigerant condensed by the condenser 120 may be introduced into the second evaporator 160 through the flow control part 130. At this time, the flow control part 130 may be switched into the third activation mode.

When the flow control part 130 is switched into the third activation mode, the first and third discharging parts 130*a* and 130*c* of the flow control part 130 are closed, and the second discharging part 130*b* is opened. Therefore, the refrigerant may be introduced into the second evaporator 160 through the second branch pipe 103 (S34).

And the valve device 175 is closed, and the flow of the refrigerant through the bypass pipe 170 is restricted. Therefore, the refrigerant passing through the second evaporator 160, which flows from the second connection part 170*a* to the bypass pipe 170, is restricted, and may be introduced into the second compressor 115 through the second inlet pipe 115*a* (S35).

While the refrigerant passes through the second evaporator 160, the second evaporator fan 165 is driven to assist the evaporation of the refrigerant. The cold air generated from the second evaporator 160 is supplied to the freezing chamber to cool the freezing chamber.

And the first evaporator fan 155 may be driven. As described above, the flow of the refrigerant in the first branch pipe 101 and the bypass pipe 170 is restricted, and the defrosting operation of the first evaporator 150 may be performed by air of the refrigerating chamber which flows by the first evaporator fan 155 (air defrosting operation). Here, an air temperature of the refrigerating chamber is about 2 to 5° C.

A refrigerant evaporating temperature of the first evaporator 150 is about −5° C. This is higher than a refrigerant evaporating temperature (about −25° C.) of the second evaporator 160. Therefore, frost formed on the first evaporator 150 may be more easily removed than that formed on the second evaporator 160.

Therefore, in the embodiment, it is proposed that the air of the refrigerating chamber is supplied to the evaporator at the refrigerating chamber to perform the defrosting operation.

The refrigerant compressed by the second compressor 115 may be discharged into the first inlet pipe 111*a*, and may be introduced into the first compressor 111. This cycle may be repeated (S36).

By the above-described structure and control method of the refrigerator, the simultaneous cooling operation of the refrigerating chamber and the freezing chamber and the defrosting operation of the freezing chamber or the refrigerating chamber may be effectively performed according to the operation mode of the refrigerator. Therefore, a heater for performing the defrosting operation of the evaporator is not required, and thus a power consumption may be reduced.

INDUSTRIAL APPLICABILITY

According to the embodiment of the present disclosure, since one refrigerant passage extending from the flow control part to the refrigerating chamber side evaporator and two refrigerant passages extending to the freezing chamber side evaporator are installed, and the bypass passage extending to the entrance side of the refrigerating chamber side evaporator is installed at the exit side of the freezing chamber side evaporator, the defrosting operation of the refrigerating chamber or the freezing chamber can be easily performed, and thus the industrial applicability can be remarkably enhanced.

The invention claimed is:

1. A refrigerator comprising:

a compressor configured to compress a refrigerant;

a condenser configured to condense the refrigerant compressed by the compressor;

a flow control part disposed at an exit side of the condenser to switch a flow direction of the refrigerant condensed by the condenser;

a plurality of branch pipes configured to extend from the flow control part;

a plurality of evaporators connected to the plurality of branch pipes, the plurality of evaporators comprising a refrigerating chamber side evaporator and a freezing chamber side evaporator; and a bypass pipe that extends from an exit side of the freezing chamber side evaporator to an inlet side of the refrigerating chamber side evaporator, wherein the compressor comprises a first compressor disposed at an exit side of the refrigerating chamber side evaporator and a second compressor disposed at an exit side of the freezing chamber side evaporator, the first compressor being configured to receive refrigerant compressed by the second compressor, wherein the plurality of branch pipes comprise a first branch pipe that extends from the flow control part to the refrigerating chamber side evaporator and second and third branch pipes that extend from the flow control part to the freezing chamber side evaporator, the second branch pipe comprising a first connection part to which the third branch pipe is connected, and wherein the refrigerator further comprises:

a second inlet pipe that extends from the freezing chamber side evaporator to the second compressor, a second connection part disposed at the second inlet pipe and connected to a first end of the bypass pipe, a third connection part disposed at the first branch pipe and connected to a second end of the bypass pipe, a first expander disposed at the first branch pipe and configured to depressurize refrigerant, a second expander disposed at the second branch pipe and configured to depressurize refrigerant, a bypass expander disposed at the bypass pipe and configured to depressurize refrigerant, and a valve device disposed at the bypass pipe and configured to selectively open and close the bypass pipe.

2. The refrigerator of claim 1, wherein the flow control part operates to:

discharge refrigerant condensed by the condenser to the first and second branch pipes in a simultaneous cooling operation mode of storage chambers, discharge refrigerant condensed by the condenser to the third branch pipe in a freezing chamber defrosting operation mode, and discharge refrigerant condensed by the condenser to the second branch pipe in a refrigerating chamber defrosting operation mode.

3. A method of controlling a refrigerator that includes a compressor, a condenser, a first evaporator, a second evaporator, a flow control part installed at inlet sides of the first and second evaporators, and a controller configured to operate the flow control part, the method comprising:

driving the compressor to operate a refrigeration cycle;

controlling an activation mode of the flow control part such that a refrigerant is supplied to at least one of the first and second evaporators; and selectively opening a bypass pipe that extends from an exit side of the second evaporator to an inlet side of the first evaporator, wherein the refrigerator further comprises:

a first branch pipe that extends from the flow control part to the first evaporator, a first expander disposed at the first branch pipe, a second branch pipe that extends from the flow control part to the second evaporator, a second expander disposed at the second branch pipe, and a third branch pipe that extends from the flow control part to the second evaporator, the second branch pipe comprising a first connection part connected to the third branch pipe, wherein the compressor comprises a first compressor disposed at an exit side of the first evaporator and a second compressor disposed at an exit side of the second evaporator, the first compressor being configured to receive refrigerant compressed by the second compressor, wherein the refrigerator further comprises:

a second inlet pipe that extends from the second evaporator to the second compressor, a second connection part disposed at the second inlet pipe and connected to a first end of the bypass pipe, a third connection part disposed at the first branch pipe and connected to a second end of the bypass pipe, a bypass expander disposed at the bypass pipe and configured to depressurize refrigerant, and a solenoid valve disposed at the bypass pipe and configured to selectively open and close the bypass pipe, and wherein the method further comprises, in an operation mode of the refrigerator:

switching the flow control part into an activation mode to supply refrigerant to the second branch pipe, closing the solenoid valve to restrict a flow of refrigerant, and driving a first evaporator fan disposed at a side of the first evaporator.

4. The method of claim 3, further comprising:

in a first operation mode of the refrigerator, switching, by the controller, the flow control part into a first activation mode to supply refrigerant to the first and second branch pipes, wherein the first operation mode is an operation mode for cooling.

5. The method of claim 3, further comprising:

in a second operation mode of the refrigerator, switching, by the controller, the flow control part into a second activation mode to supply refrigerant to the third branch pipe, and opening a valve device disposed at the bypass pipe, wherein the second operation mode is an operation mode for defrosting.

6. The method of claim 5, wherein the refrigerator further comprises:

a condenser fan installed at one side of the condenser to generate an air flow; and an evaporator fan installed at each one side of the first and second evaporators, and wherein the method further comprises, in the second operation mode of the refrigerator, turning off the condenser fan, and driving the evaporator fan.

* * * * *